United States Patent [19]

Schmitz

[11] Patent Number: 4,691,720

[45] Date of Patent: Sep. 8, 1987

[54] APPLIANCE FOR PARTIALLY DYEING THE HAIR

[76] Inventor: Wolfgang Schmitz, Aachener Strasse 609, 5000 Köln 41, Fed. Rep. of Germany

[21] Appl. No.: 768,468

[22] Filed: Aug. 22, 1985

[30] Foreign Application Priority Data

Apr. 17, 1985 [DE] Fed. Rep. of Germany ..... 3513814

[51] Int. Cl.[4] ..... A45D 24/22

[52] U.S. Cl. ..... 132/112

[58] Field of Search ..... 132/112, 151, DIG. 3; 15/104.93, 104.94, 257.05; 401/118, 119, 268, 191, 123, 36

[56] References Cited

U.S. PATENT DOCUMENTS

| | | | |
|---|---|---|---|
| 2,228,091 | 1/1941 | Smith | 132/112 |
| 2,292,381 | 8/1942 | Klaggs | 401/119 |
| 2,413,682 | 1/1947 | Brown | 401/123 |
| 3,419,021 | 12/1968 | Ruffin | 132/112 |
| 4,566,472 | 1/1986 | Mueller et al. | 132/112 |

*Primary Examiner*—Robert P. Swiatek
*Assistant Examiner*—Cary E. Stone
*Attorney, Agent, or Firm*—Browdy and Neimark

[57] ABSTRACT

An appliance for partially dyeing the hair consists of a comb-like part (1), a handle part (2) connected thereto and a dye applicator device (3). In order to give the appliance a simple construction and to conform it so that it operates without faults and is particularly easy to use, the dye applicator device is constructed as a brush device (4) which is movable relative to the comb part (1) between a dye collecting position, in which the bristles (6) point away from the comb part (1), and a dye dispensing position, in which the bristles (6) are in contact with the comb teeth (15). The brush device (4) is pivotable about an axis oriented approximately parallel to the comb part (1), and can be actuated by use of a pivot lever (13).

20 Claims, 8 Drawing Figures

APPLIANCE FOR PARTIALLY DYEING THE HAIR

Figure 1:
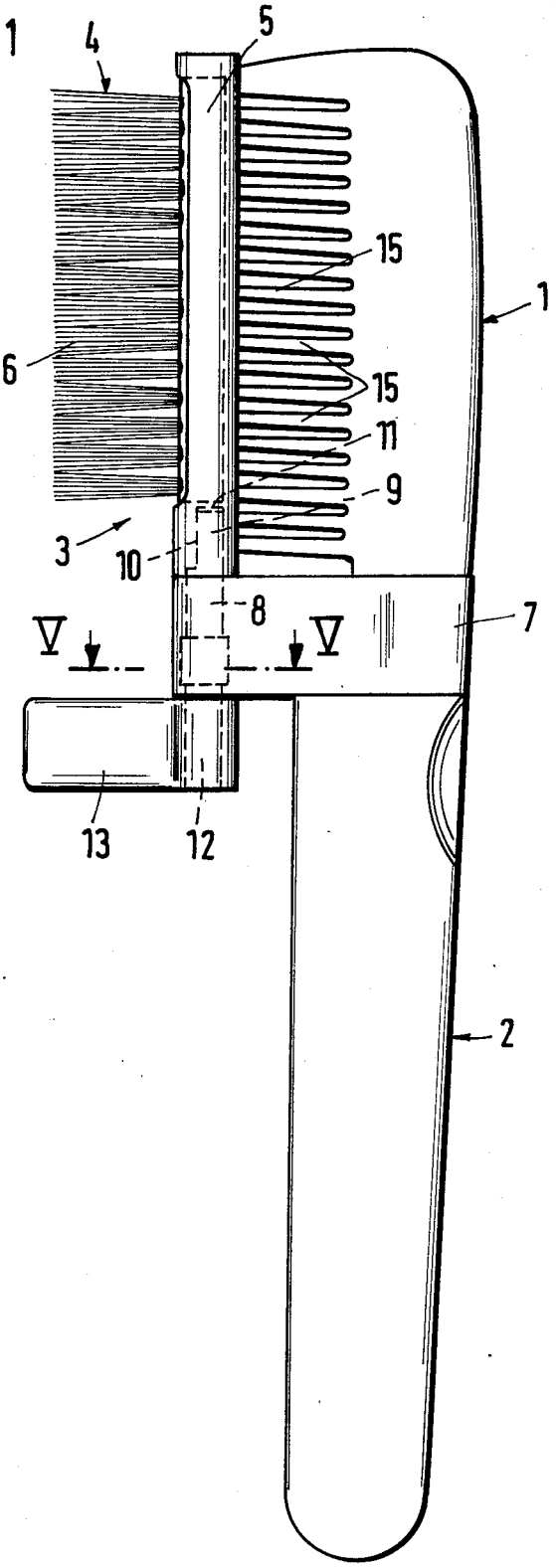

The invention relates to an appliance for partially dyeing the hair, consisting of a comb-like part, a handle part connected thereto, and a dye applicator device.

A hair dyeing comb is known from German Pat. No. 857,852, in which the liquid dye is fed from a central dye tank through feed bores to each individual comb tooth. Apart from the fact that such an appliance is relatively complicated, faults can easily arise due to the dye feed bores clogging and the dye failing to pass into all those regions of the hair which the hairdresser wishes to dye.

The majority of hairdressing salons still work without special hair dyeing appliances. For example, the hairdresser combs out individual strands to be dyed and applies the dye to them with a brush. However, this method of dyeing is difficult and time-wasting and requires a practised hand, particularly if it is desired to achieve stylish effects by dyeing individual narrow strands.

The underlying aim of the invention is to develop an appliance of the type initially stated which is simple in construction, operates without faults and is particularly easy to use.

This aim is achieved according to the invention when the dye applicator device exhibits a brush device which is movable relative to the comb part between a dye collecting position in which the bristles point away from the comb part and a dye dispensing position in which the bristles are in contact with the comb teeth.

It is extremely simple to work with the appliance according to the invention, even for unpractised persons. The brush device is first of all moved into the dye collecting position, and can thus be dipped into the liquid dye. Then the brush device is moved into the dye surrendering position, in which the bristles are in contact with the comb teeth. In this position of the brush device, the comb part can be drawn through the strands to be dyed, whilst the liquid dye adhering to the bristles is transferred to the hair. The mechanism of the appliance is extremely simple, because it is only necessary to provide a movement mechanism for the brush device. Faults are virtually eliminated, because the transfer of the dye by means of a brush device is extremely simple. Dye cartridges and narrow dye feed bores are unnecessary, because the brush only needs to be dipped into a flat dish filled with liquid dye, which is available in every hairdressing salon.

Conveniently, the bristles on the brush device point substantially in the same direction, whilst the element supporting the bristles is pivotable about an axis oriented substantially parallel to the comb part. Such a flat brush device presents a good dye transfer effect and is easy to handle.

The bristles on the brush device, in their dye surrendering position, are preferably oriented in the opposite direction to the comb teeth. This bristle position in the work position permits optimum working, because whilst the comb part is passed through the hair with teeth oriented obliquely forward, the bristles impregnated with liquid dye travel with the hair and therefore sweep very lightly across the strands of hair traveling through the comb.

A laterally projecting bracket, which exhibits a pivot bearing for the brush support element, may be arranged in the region of the appliance between the comb part and the handle part. A short axle element, which is mounted in the pivot bearing, may exhibit on its side facing the comb part a housing device for the brush support element. In this manner the brush device can be mounted pivotably for a small outlay without the pivoting mechanism interfering when working with the appliance.

The housing device is preferably constructed as an acircular support pin onto which the brush support element is pluggable. By this plug-on mechanism it is immediately possible to exchange the brush device at will and to replace it by new, possibly differently shaped, brush devices which are adapted to the particular application.

The support pin conveniently exhibits a cylindrical cross-section with a lateral flattened part, whilst the brush support element is provided with a correspondingly constructed housing orifice. In this manner, only one plugging-on possibility exists, so that the brush device always occupies its correct position after being plugged on.

The axle element mounted in the pivot bearing may exhibit, on the side facing the handle part, a prolongation part upon which a radially projecting pivot lever is arranged integrally in rotation. The latter can be actuated conveniently by the thumb, so that the brush device can easily be moved in reciprocation between its prescribed positions. The support element of the brush device may be subject to a spring pretension directed towards the dye collecting position. In this manner it is only necessary to exert pressure upon the pivot lever in one direction in order to press the brush device into its dye surrendering position each time. The pivoting back then occurs automatically as soon as the contact pressure exerted upon the pivot lever is reduced below a given value.

In order to facilitate working, an auxiliary character position of the brush support element may be provided at a short angular interval before the dye surrendering position. Faster working is thereby possible because the brush device consequently always occupies a position of readiness, from which it is only a short distance into the dye surrendering position. In order to pivot the brush device into the remote dye collecting position, it is necessary to overcome the catch position by a light thumb pressure.

In order to fix the auxiliary catch position, a catch device may be provided which exhibits a catch cam with a countercam depressable thereby counter to a spring force. This catch position, which considerably facilitates handling, can be overcome by a light pressure against the pivot lever when it is required to move the brush device into the dye collecting position.

The exchangeable brush support element may, for example, be provided with bristles along the total length of the comb part. If it is required to dye only relatively narrow strands, an exchangeable brush support element is employed, in which only a region corresponding to the width of the hair strand to be dyed is provided with bristles. Alternatively, clearances may also be provided between the groups of bristles, so that a plurality of strands can be dyed simultaneously.

Figure 2:
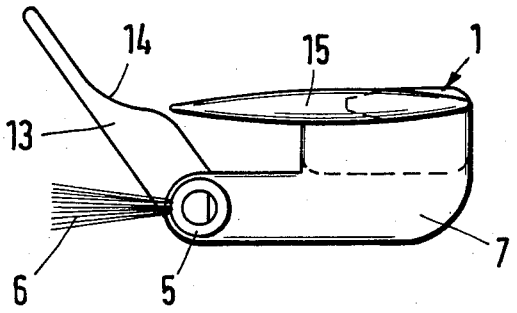
Figure 3:
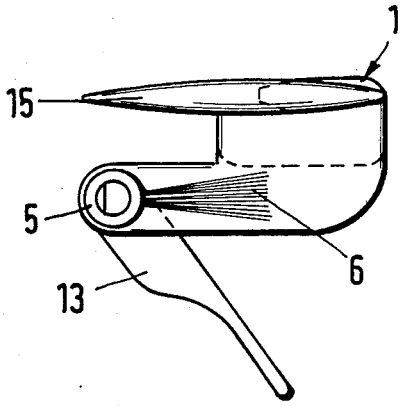
Figure 4:
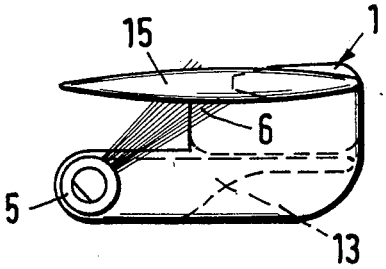
Figure 5:
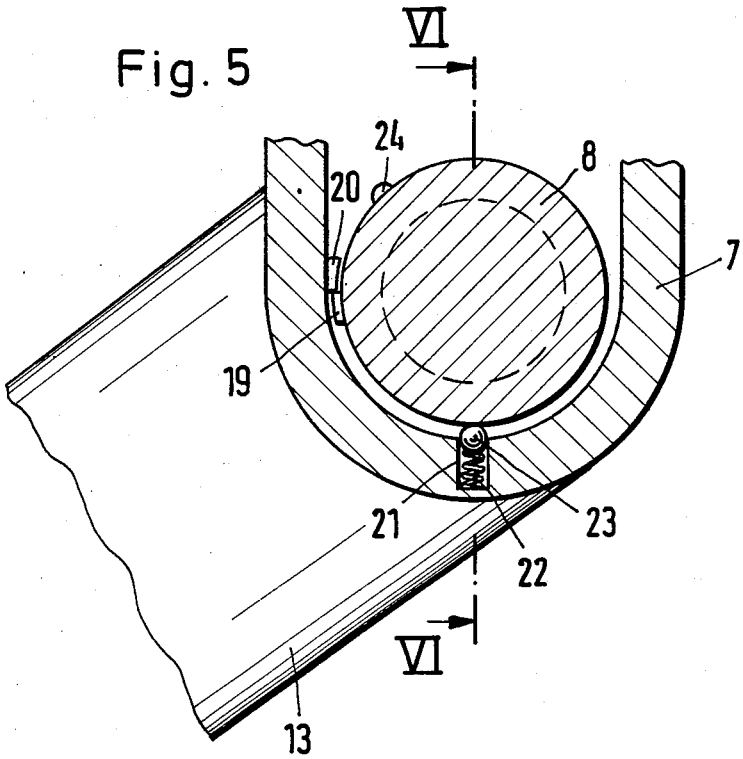
Figure 6:
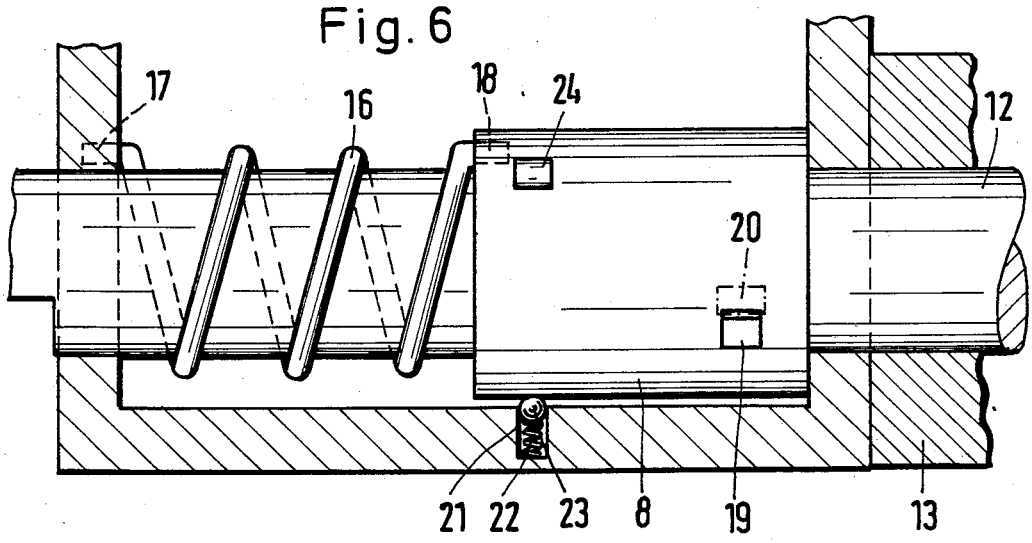
Figure 7:
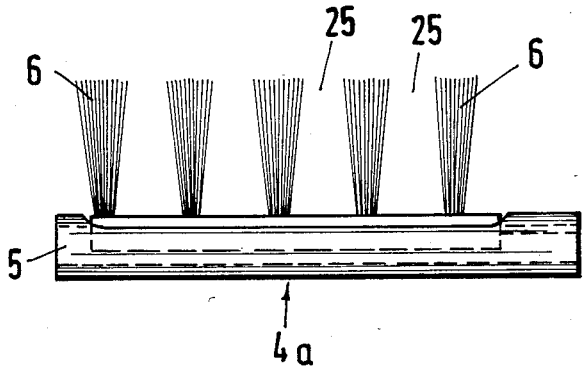
Figure 8:
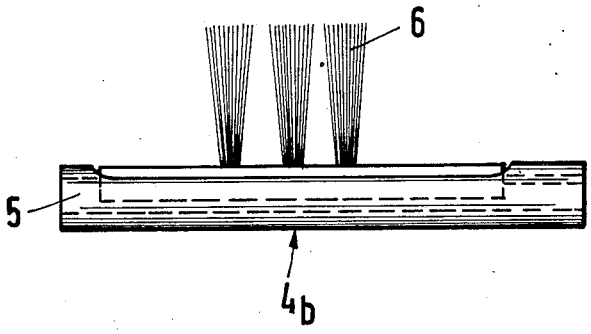

Examples of the invention are illustrated in the drawing, and described below in detail with reference to the drawing, wherein:

FIG. 1 shows a side elevation of the appliance, in which the brush device occupies the dye collecting position, FIG. 2 shows an end elevation of the appliance according to FIG. 1, FIG. 3 shows the same end elevation as FIG. 2, in which the brush device occupies its catch position directly before the dye surrendering position, FIG. 4 shows the same end elevation, in which the brush device occupies the dye surrendering position, FIG. 5 shows on a larger scale a section along the line V—V from FIG. 1, FIG. 6 shows a section along the line VI—VI from FIG. 5, FIG. 7 shows another embodiment of the brush device with clearances between individual bristle regions and FIG. 8 shows a further embodimemt of the brush device, in which the bristles are arranged only in a narrow region.

According to the drawing, the appliance, with which individual strands of hair can be dyed, consists of a comb-like part 1, a handle part 2 connected thereto and a dye applicator device 3, with which liquid dye can be applied to a strand of hair drawn through the comb part 1.

The dye applicator device 3 consists substantially of a brush device 4, which is formed by a cylindrical support element 5 and a plurality of bristles 6, which are attached to the support element 5 in a plane so that they all point substantially in the same direction.

The brush support element 5 is supported by a bracket 7 which is arranged projecting laterally between the comb part 1 and the handle part 2. An axle element 8, which is mounted in the bracket 7, is provided on its side facing the comb part 1 with a support pin 9 onto which the brush support element 5 can easily be plugged. The support pin 9 exhibits a cylindrical cross-section and is provided with a lateral flattened part 10, whilst that end of the support element 5 facing the bracket 7 is provided with a corresponding housing orifice 11. By this means the brush support element 5 can be plugged integrally in rotation onto the support pin 9 on the axle element 8. A fixing of the support element 5 in the axial direction occurs in that the support pin 9 is mounted at a slight press fit in the housing orifice 11, however the fit is chosen so that easy withdrawal of the support element 5 is also possible.

On its side facing the handle part 2, the axle element 8 exhibits a prolongation part 12 projecting out of the bracket 7, upon which a radially projecting pivot lever 13 is arranged integrally in rotation. By means of the pivot lever 13 the brush support element 5 can easily be rotated so that the bristles 6 can be pivoted conveniently out of the dye collecting position illustrated in FIGS. 1 and 2 via a catch position illustrated in FIG. 3 into the dye surrendering position illustrated in FIG. 4. The pivot lever 13 exhibits at its end a rounded recess 14, so that the pivot lever 13 can be actuated conveniently with the thumb, in which case the pivot lever produces a rotation of the brush support element 5 about its axis oriented parallel to the comb part 1.

The pivot axis of the brush support element 5 is located in the region of the free end of the comb teeth 15 and is staggered laterally somewhat relative thereto. When the bristles 6 occupy the dye collecting position they project beyond the comb teeth, so that the bristles can be dipped conveniently into a liquid dye present in a dish. In their dye surrendering position, in which they are required to transfer the liquid dye collected to a strand of hair drawn through the comb part, the bristles 6 are located in the opposite direction to the comb teeth 15 in their root region, so that thorough dyeing of the strands from the hair root onwards is possible. When the strand of hair is drawn through the comb, it travels synchronously with the bristles 6, so that easy sliding through the strand of hair, and good dye application, are possible.

In order to facilitate the rotation of the brush support element 5, the axle element 8 mounted in the bracket 7 is loaded by a spring tension which rotates the axle element to a position corresponding to the dye collecting position. The spring pre-tension is obtained by a helicoidal spring 16 which extends round the cylindrical axle element 8 within the bracket 7 constructed as a housing. The one end 17 of the helicoidal spring 16 is attached in the wall of the bracket 7, whereas the other end 18 is connected to the axle element 8. The helicoidal spring 16 is fitted so that it is relaxed in the dye collecting position of the brush device illustrated in FIG. 1, and becomes tensioned when the brush device is pivoted into the dye surrendering position. It is therefore only necessary for the pivot lever 13 to be pressed in one direction by the thumb, whereas the return movement then occurs automatically when the thumb pressure diminishes.

The dye collecting position is defined by a stop which is arranged in the interior of the bracket. A pin 19 provided on the axle element 8, which strikes against a projection 20 provided firmly on the bracket, serves as a stop. By the power of the helicoidal spring 16, the brush device 4 is retained in this stop position defining the dye collecting position.

The dye dispensing position, which is the principal work position, is limited by the fact that the pivot lever 13 to be actuated by the thumb comes into abutment with the handle part 2. In this work position the pivot lever 13 must be held by a light thumb pressure in order to overcome the power of the return spring 16. The contact force of the bristles 6 on the comb part 1 can be reduced by slightly lifting the pivot lever 13 from the handle part 2. The brush support element 5 then, by the power of the helicoidal spring 16, rotates somewhat towards the dye collecting position, whereby the bristles are moved away somewhat out of the dye surrendering position, so that they either contact the comb part 1 with weaker pressure or else lift somewhat from the latter.

In addition to the two definite positions of the brush device 4 described above, the catch position defined in terms of the device is provided, which is located a short interval before the work position. In this catch position the bristles 6 are located approximately parallel to the comb teeth 15, so that a strand of hair can be combed out without the latter coming into contact with the bristles. By a slight pressure on the pivot lever 13, which is located at a short interval above the handle part 2, the brush support element 5 can then be pivoted into its work position. This auxiliary catch position is defined by the fact that a bore 21 is provided in the interior of the bracket 7 immediately opposite the axle element 8, in which a ball 23 loaded by a compression spring 22 is guided, which protrudes somewhat out of the bore 21 and is in contact with the axle element 8. The axle element 8 is provided, in the same cross-sectional plane, with a projecting cam 24 which rides up on the spring-loaded ball 23. The tension which the compression spring 22 exerts upon the ball 23 is adjusted so that the cam 24 is retained by the ball 23, that is to say, the force of the helicoidal spring 16 rotating the axle element 8 is not alone sufficient to press the cam 24 past the spring-loaded ball. A rotation of the brush device 4 out of the catch position into the dye collecting position can occur only by performing the manual actuation of the pivot lever 13 in addition to the force of the return spring 16.

In the embodiments illustrated in FIGS. 1 to 4, the brush device 4 exhibits a row of bristles extending continuously along virtually the total length of the comb part 1. This brush device is particularly suitable for dyeing relatively wide strands of hair. On the other hand, if only very narrow strand regions are required to be dyed, then the brush device 4*a* illustrated in FIG. 7 may be employed, in which clearances 25 are provided between individual bristle regions, so that when the comb part 1 travels through a relatively wide strand of hair, only individual narrow regions of this strand of hair become dyed. In the embodiment illustrated in FIG. 8, the brush device 4*b* is provided with bristles 6 only in its central region, so that the width of the strand region to be dyed is precisely dictated thereby.

According to individual applications, the brush devices may also be shaped differently. Before the hairdresser commences to dye the strands of hair, he selects a given brush device and plugs its support element 5 onto the support pin 9 provided on the axle element 8.

I claim:

1. An appliance for partially dyeing the hair, including a comb part (1), a handle part connected thereto and a dye applicator device (3) connected therebetween, wherein the dye applicator device (3) comprises a brush device (4; 4*a*; 4*b*) including an element (5) supporting bristles 6, the element (5) is movable relative to the comb part (1) between a dye collecting position in which the bristles (6) point away from the comb part (1) and a dye dispensing position in which the bristles (6) are in contact with the comb teeth (15), the bristles (6) of the brush device (4; 4*a*; 4*b*) being pointable substantially in one and the same direction, and the element (5) supporting the bristles (6) is pivotable about an axis oriented substantially parallel to the comb part (1).

2. An appliance as claimed in claim 1, wherein the bristles (6) of the brush device (4; 4*a*; 4*b*), in their dye surrendering position, are located approximately in the opposite direction to the comb teeth (15).

3. An appliance as claimed in claim 1, wherein a laterally projecting bracket (7), which exhibits a pivot bearing for the brush support element (5), is arranged in a region of the appliance between the comb part (1) and the handle part (2).

4. An applance as claimed in claim 3, wherein a short axle element (8), which is mounted in the pivot bearing, exhibits on its side facing the comb part (1) a housing device for the brush support element (5).

5. An appliance as claimed in claim 4, wherein the housing device is constructed as an acircular support pin (9) onto which the brush support element (5) is pluggable and the brush device (4; 4*a*; 4*b*) is thereby exchangeable.

6. An appliance as claimed in claim 5, wherein the support pin (9) exhibits a cylindrical cross-section with a lateral flattened part (10), whilst the brush support element (5) is provided with a correspondingly constructed housing orifice (11).

7. An appliance as claimed in claim 4, wherein the axle element (8) exhibits, on its side facing the handle part (2), a prolongation part (12) upon which a radially projecting pivot lever (19) is arranged integrally in rotation.

8. An appliance as claimed in claim 3, wherein the brush support element (4) is exchangeable and provided with bristles (6) approximately along the total length of the comb part (1).

9. An appliance as claimed in claim 3, wherein the brush support element (4*b*) is exchangeable and provided with bristles (6) across a region corresponding to the width of the strand of hair to be dyed.

10. An appliance as claimed in claim 3, wherein clearances (25) are provided between individual groups of bristles.

11. An appliance as claimed in claim 1 wherein the support element (5) of the brush device (4; 4*a*; 4*b*) is subject to a spring pretension (spring 16) directed towards the dye collecting position.

12. An appliance as claimed in claim 1, wherein an auxiliary catch position of the brush support element (5) is provided at a short angular interval before the dye surrendering position.

13. An appliance as claimed in claim 12, wherein a catch device which exhibits a catch cam (24) and a countercam (23) depressable thereby counter to a spring force is provided to fix the auxiliary catch position.

14. An appliance for partially dyeing the hair, comprising of a comb device with a comb part and a handle part connected thereto, and a dye applicator device having a brush device with bristles and an element supporting the bristles, wherein said bristles of the brush device are pointable substantially in one and the same direction, whilst the element supporting the bristles is journaled at the comb part about an axis oriented substantially parallel to the comb part between a dye collecting position in which the bristles point away from the comb part and a dye surrendering position in which the bristles are in contact with the comb teeth, and said bristles of the brush device, in their dye surrendering position, are oriented approximately in the opposite direction to the comb teeth.

15. An appliance as claimed in claim 14, wherein a laterally projecting bracket, which exhibits a pivot bearing for said element supporting the bristles, is arranged in a region of the appliance between the comb part and the handle part.

16. An appliance as claimed in claim 15, wherein a short axle element, which is mounted in the pivot bearing, has on its side facing the comb part a housing device for said element supporting the bristles.

17. An appliance as claimed in claim 16, wherein the housing device is constructed as an acircular support pin onto which said element supporting the bristles is pluggable, the brush device being thereby exchangeable.

18. An appliance as claimed in claim 17, wherein the support pin exhibits a cylindrical cross-section with a lateral flattened part, whilst the brush support element is provided with a correspondingly constructed housing orifice.

19. An applance as claimed in claim 18, wherein said element supporting the bristles is subject to a spring pretension directed in a direction of said dye collecting position.

20. An appliance as claimed in claim 16, wherein said axle element has on its side facing the handle part a prolongation part upon which a radially projecting pivot lever is arranged integrally for rotation.

* * * * *